US008220564B2

(12) United States Patent
Runquist et al.

(10) Patent No.: US 8,220,564 B2
(45) Date of Patent: Jul. 17, 2012

(54) DEVICES AND METHODS FOR DYNAMIC BORING PROCEDURE RECONFIGURATION

(75) Inventors: Randy Ray Runquist, Knoxville, IA (US); Hans Kelpe, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 934 days.

(21) Appl. No.: 12/229,904

(22) Filed: Aug. 27, 2008

(65) Prior Publication Data

US 2009/0062804 A1 Mar. 5, 2009

Related U.S. Application Data

(60) Provisional application No. 60/966,297, filed on Aug. 27, 2007.

(51) Int. Cl.
*E21B 7/10* (2006.01)

(52) U.S. Cl. ..... 175/61; 175/62; 73/152.43

(58) Field of Classification Search ..... 175/24, 175/26, 40, 45, 50, 61, 62; 73/152.43; 33/304; 340/853.4

See application file for complete search history.

(56) References Cited

U.S. PATENT DOCUMENTS 3,731,752 A 5/1973 Schad
4,165,789 A 8/1979 Rogers
4,602,560 A 7/1986 Jacky
4,733,733 A 3/1988 Bradley et al.
4,787,463 A 11/1988 Geller et al.
4,793,421 A 12/1988 Jasinski
4,854,397 A 8/1989 Warren et al.
4,953,638 A 9/1990 Dunn
5,133,417 A 7/1992 Rider
5,155,442 A 10/1992 Mercer
5,174,033 A 12/1992 Rider
5,231,355 A 7/1993 Rider et al.
5,264,795 A 11/1993 Rider
5,318,136 A 6/1994 Rowsell et al.
5,337,002 A 8/1994 Mercer (Continued)

OTHER PUBLICATIONS

Kathage, Proceedings of the Fourth International Conference on Ground Penetrating Radar, Geological Survey of Finland, *A Challenge: GPR in Advance of Horizontal Drilling*. Special Paper 16, Jun. 1992, pp. 119-124.

(Continued)

*Primary Examiner* — Daniel P Stephenson

(74) *Attorney, Agent, or Firm* — Hollingsworth & Funk, LLC

(57) ABSTRACT

Various embodiments are directed to a method of switching horizontal directional drilling procedures during bore path turning. Such methods can include identifying a hierarchal arrangement of a plurality of different boring procedures utilizing different boring techniques, the hierarchy arrangement representing boring procedures of increasing ability to bore through harder soil while changing a trajectory of a boring tool. Such methods can further include boring a first leg of a curved bore path using a boring tool connected to a drill rig by a drill string, the first leg being bored using a first boring procedure of the plurality of different boring procedures. Such methods can further include monitoring a plurality of boring parameters during boring of the first leg, the plurality of boring parameters comprising: torsional pressure of the drill string, rotational travel of the drill string, hydraulic pressure, and axial displacement. Such methods can further include switching from boring the first leg of the curved bore path using the first boring procedure to boring a second leg using a second boring procedure of the plurality of boring procedures, the switch based on one or more of the boring parameters deviating past a threshold.

22 Claims, 4 Drawing Sheets

U.S. PATENT DOCUMENTS 5,355,965 A 10/1994 Rozendaal
5,361,021 A 11/1994 Meyer et al.
5,444,382 A 8/1995 Mercer
5,469,155 A 11/1995 Archambeault et al.
5,585,726 A 12/1996 Chau
5,621,325 A 4/1997 Draper
5,633,589 A 5/1997 Mercer
5,698,981 A 12/1997 Mercer
5,703,484 A 12/1997 Bieberdorf et al.
5,711,381 A 1/1998 Archambeault et al.
5,746,278 A 5/1998 Bischel et al.
5,764,062 A 6/1998 Mercer
5,767,678 A 6/1998 Mercer
5,872,703 A 2/1999 Williams et al.
5,926,025 A 7/1999 Mercer
5,933,008 A 8/1999 Mercer
5,990,682 A 11/1999 Mercer
5,990,683 A 11/1999 Mercer
6,002,258 A 12/1999 Mercer
6,005,532 A 12/1999 Ng
6,008,651 A 12/1999 Mercer
6,014,026 A 1/2000 Mercer
6,029,754 A 2/2000 Kattentidt et al.
6,035,951 A 3/2000 Mercer
6,047,783 A 4/2000 Mercer
6,057,687 A 5/2000 Mercer
6,075,506 A 6/2000 Bonnett et al.
6,095,260 A 8/2000 Mercer
6,131,062 A 10/2000 Nielsen
6,160,401 A 12/2000 Mercer
6,161,630 A 12/2000 Stump et al.
6,232,780 B1 5/2001 Mercer
6,233,524 B1 5/2001 Harrell et al.
6,250,402 B1 6/2001 Brune et al.
6,279,668 B1 8/2001 Mercer
6,285,190 B1 9/2001 Brune et al.
6,292,729 B2 9/2001 Falck et al.
6,305,951 B1 10/2001 Shih et al.
6,364,035 B2 4/2002 Brune et al.
6,396,275 B1 5/2002 Mercer
6,417,666 B1 7/2002 Mercer
6,454,023 B1 9/2002 Mercer et al.
6,457,537 B1 10/2002 Mercer et al.
6,496,008 B1 12/2002 Brune et al.
6,525,538 B1 2/2003 Mercer
6,536,538 B2 3/2003 Brune et al.
6,559,646 B2 5/2003 Mercer
6,593,745 B2 7/2003 Mercer
6,640,907 B2 11/2003 Mercer et al.
6,640,943 B1 11/2003 Daws
6,651,755 B1 11/2003 Kelpe
6,653,837 B2 11/2003 Brune et al.
6,668,944 B2 12/2003 Brune et al.
6,693,429 B2 2/2004 Mercer
6,727,704 B2 4/2004 Brune et al.
6,749,029 B2 * 6/2004 Alft et al. ..... 175/24
6,756,783 B2 6/2004 Brune et al.
6,756,784 B2 6/2004 Mercer
6,768,307 B2 7/2004 Brune et al.
6,838,881 B2 1/2005 Mercer
6,838,882 B2 1/2005 Mercer
6,856,135 B2 2/2005 Brune et al.
6,868,921 B2 3/2005 Burrows et al.
6,917,202 B2 7/2005 Brune et al.
6,920,943 B2 7/2005 Mercer et al.
6,924,645 B2 8/2005 Mercer
6,935,439 B2 8/2005 Mercer
6,954,073 B2 10/2005 Mercer
6,963,201 B2 11/2005 Brune et al.
6,975,119 B2 12/2005 Brune et al.
7,011,166 B2 3/2006 Koch et al.
7,015,697 B2 3/2006 Brune et al.
7,021,403 B2 4/2006 Brune et al.
7,049,820 B2 5/2006 Mercer
7,061,244 B2 6/2006 Mercer
7,080,698 B2 7/2006 Mercer et al.
7,084,636 B2 8/2006 Brune et al.
7,111,693 B1 9/2006 Self et al.
7,150,331 B2 12/2006 Cole et al.
7,154,273 B2 12/2006 Mercer
7,159,672 B2 1/2007 Mercer et al.
7,165,632 B2 1/2007 Burrows et al.
7,167,005 B2 1/2007 Mercer
7,176,690 B2 2/2007 Brune et al.
7,896,107 B2 * 3/2011 Gunsaulis et al. ..... 175/61
2009/0090555 A1 * 4/2009 Boone et al. ..... 175/45
2009/0205868 A1 * 8/2009 Lane ..... 175/24
2011/0214878 A1 * 9/2011 Bailey et al. ..... 166/369

OTHER PUBLICATIONS

Landberg, *Light Equipment, Boring System Monitor Detects Changes*, Construction Equipment, May 1995, p. 104.
PCT International Search Report and Written Opinion for PCT Application No. PCT/US2008/010151, dated Apr. 3, 2009.
Vermeer Manufacturing Company, D-14/D-24, Brochure, 1994.
Vermeer Manufacturing Company, D-7/D-10, Brochure, 1994.

* cited by examiner

DEVICES AND METHODS FOR DYNAMIC BORING PROCEDURE RECONFIGURATION

RELATED APPLICATIONS

This application claims the benefit of Provisional Patent Application Ser. No. 60/966,297, filed on Aug. 27, 2007, to which Applicant claims priority under 35 U.S.C. §119(e), and which is incorporated herein by reference in its entirety.

FIELD OF THE INVENTION

The present invention relates generally to the field of underground boring and, more particularly, to a system and method for reconfiguring a boring procedure to optimize boring efficiency.

BACKGROUND OF THE INVENTION

Utility lines for water, electricity, gas, telephone, and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench may pose a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also known as horizontal directional drilling (HDD) or trenchless underground boring, a boring system is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the earth's surface. A reamer is then attached to the drill string which is pulled back through the borehole, thus reaming out the borehole to a larger diameter. It is common to attach a utility line or other conduit to the reaming tool so that it is dragged through the borehole along with the reamer.

Another technique associated with horizontal directional drilling, often referred to as push reaming, involves attaching a reamer to the drill string at the entry side of a borehole after the boring tool has exited at the exit side of the borehole. The reamer is then pushed through the borehole while the drill rods being advanced out of the exit side of the borehole are individually disconnected at the exit location of the borehole. A push reaming technique is sometimes used because it advantageously provides for the recycling of the drilling fluid. The level of direct operator interaction with the drill string, such as is required to disconnect drill rods at the exit location of the borehole, is much greater than that associated with traditional horizontal directional drilling techniques.

SUMMARY OF THE INVENTION

The present invention is directed to a system and method of dynamic boring procedure reconfiguration.

Various method embodiments are directed to switching horizontal directional drilling procedures during bore path turning. Such methods can include identifying a hierarchal arrangement of a plurality of different boring procedures utilizing different boring techniques, the hierarchy arrangement representing boring procedures of increasing ability to bore through harder soil while changing a trajectory of a boring tool. Such methods can further include boring a first leg of a curved bore path using a boring tool connected to a drill rig by a drill string, the first leg being bored using a first boring procedure of the plurality of different boring procedures. Such methods can further include monitoring a plurality of boring parameters during boring of the first leg, the plurality of boring parameters comprising: torsional pressure of the drill string, rotational travel of the drill string, hydraulic pressure, and axial displacement. Such methods can further include switching from boring the first leg of the curved bore path using the first boring procedure to boring a second leg using a second boring procedure of the plurality of boring procedures, the switch based on one or more of the boring parameters deviating past a threshold. In some methods, the one or more of the plurality of parameters deviating past the parameter threshold indicates that the first boring procedure is suboptimal for boring soil of the second leg with respect to another boring procedure of the plurality of boring procedures. In some methods, switching further comprises switching to using a higher boring procedure of the hierarchal arrangement when the one or more boring parameters exceeds a maximum threshold, and switching to using a lower boring procedure of the hierarchal arrangement when the one or more boring parameters falls below a minimum threshold. In some methods, the maximum threshold and the minimum threshold are each predetermined for each boring procedure of the plurality of boring procedures of the hierarchal arrangement. In some methods, the plurality of different boring procedures comprises a hierarchal arrangement of different boring procedures utilizing different boring techniques, each boring procedure of the plurality composed of a unique combination of boring actions. In some methods, monitoring the plurality of boring parameters further comprises dividing one or both of the rotational travel and the axial displacement parameters by one or both of the torsional pressure and the hydraulic pressure parameters to calculate a comparison value indicating progress compared to machine stress, and wherein the switch between the first boring procedure and the second boring procedure is based on the comparison value deviating past the threshold.

Various method embodiments are directed to a method for switching horizontal directional drilling procedures. Such methods can include boring a curved bore path using a boring tool connected to a drill rig using a first boring procedure of a plurality of different boring procedures, monitoring a plurality of boring parameters, comparing at least one of the plurality of boring parameters to a parameter threshold, and switching from boring using the first boring procedure to boring using a second boring procedure of the plurality of boring procedures, the switch based on the parameter comparison. In some methods, monitoring the plurality of boring parameters comprises monitoring at least one progress parameter indicative of boring progress and at least one operational parameter indicative of an operational state of a boring machine. In some methods, comparing at least one of the plurality of boring parameters to the parameter threshold comprises comparing at least one of the progress parameters to at least one of the operational parameters to determine a parameter comparison value, wherein switching between using the first boring procedure to using the second boring procedure of the plurality of boring procedures is based on the parameter comparison value deviating past the parameter threshold. In some methods, the parameter comparison value deviating past the parameter threshold indicates that the first boring procedure is suboptimal for efficiently boring soil of the second leg with respect to another boring procedure of the plurality of boring procedures. In some methods, the plurality of different boring procedures comprises a hierarchal arrangement of boring procedures, the hierarchy arrangement representing boring procedures of increasing ability to bore through harder soil while changing the trajectory of the boring tool. In some methods, switching further comprises switching to using a higher boring procedure of the hierarchal arrangement when the parameter exceeds a maximum threshold, and switching to using a lower boring procedure of the hierarchal arrangement when the parameter falls below a minimum threshold. In some methods, the maximum threshold and the minimum threshold are each predetermined for each boring procedure of the plurality of boring procedures.

Various apparatus embodiments are directed to a horizontal directional drilling machine. Such embodiments can include a boring tool, a drill string attached the to boring tool, a boring rig coupled to the drill string, the boring rig having one or more motors configured to manipulate the drill string to bore a curved underground path, one or more sensors configured to output one or more boring parameter signals containing boring parameter information, memory, and a controller configured to execute program instructions stored in the memory to cause the horizontal directional drilling machine to switch from boring a curved path using a first boring procedure of a plurality of different boring procedures to a second boring procedure of the plurality of different boring procedures based on the boring parameter information deviating past a parameter threshold, wherein each boring procedure of the plurality of boring procedures comprises a unique combination of boring actions that the drill rig is configured to implement. In some apparatus embodiments, the one or more sensors are configured to measure at least one progress parameter signal and output boring parameter information indicative of boring progress and at least one operational parameter signal and output parameter information indicative of machine stress of the horizontal directional drilling machine. In some apparatus embodiments, the controller is configured to execute stored program instructions to compare parameter information of at least one of the progress parameter signals to parameter information of at least one of the operational parameter signals to determine a parameter comparison value, wherein the switch between using the first boring procedure to using the second boring procedure is based on the parameter comparison value deviating past the parameter threshold. In some apparatus embodiments, the parameter comparison value deviating past the parameter threshold indicates that the first boring procedure is suboptimal for efficiently boring soil as measured by the one or more sensors with respect to another boring procedure of the plurality of boring procedures. In some apparatus embodiments, the plurality of different boring procedures comprises a hierarchal arrangement of boring procedures stored in memory, the hierarchal arrangement representing boring procedures of increasing ability to bore through harder soil along the curved path that can be implemented by the controller and the boring rig. In some apparatus embodiments, the controller is configured to execute stored program instructions to cause the horizontal directional drilling machine to switch to using a higher boring procedure of the hierarchal arrangement when the parameter information exceeds a maximum threshold, and switch to using a lower boring procedure of the hierarchal arrangement when the parameter information falls below a minimum threshold. In some apparatus embodiments, the maximum threshold and the minimum threshold are each predetermined for each boring procedure of the plurality of boring procedures. In some apparatus embodiments, the one or more sensors are configured to output parameter signals containing progress parameter information indicating boring progress along the curved path and operational information indicating stress on the horizontal directional drilling machine, and wherein the controller is configured to execute stored program instructions to calculate a comparison value indicating boring progress compared to machine stress by dividing the progress information by the operational information and switch from boring using the first boring procedure to the second boring procedure based on the comparison value deviating past the parameter threshold. In some apparatus embodiments, the boring parameter information comprises a parameter indicating curvature of the drill string.

Various embodiments are directed to a system for boring. Such a system can comprise means for mechanically boring a generally horizontal curved path through the ground using one of a plurality of boring procedures, means for monitoring one or more parameters while boring, and means for switching using one of the plurality of boring procedures to using a different one of the boring procedures when one or more of the monitored parameters deviates from a preestablished range. In such embodiments, the plurality of boring procedures may comprises a hierarchal arrangement of boring procedures, the hierarchy arrangement representing boring procedures of increasing ability to bore through harder soil while changing the trajectory of the boring tool. In such embodiments, switching can further comprises switching to using a higher boring procedure of the hierarchal arrangement when one or more of the monitored parameters exceeds a maximum threshold of the preestablished range, and switching to using a lower boring procedure of the hierarchal arrangement when one or more of the monitored parameters falls below a minimum threshold of the preestablished range.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
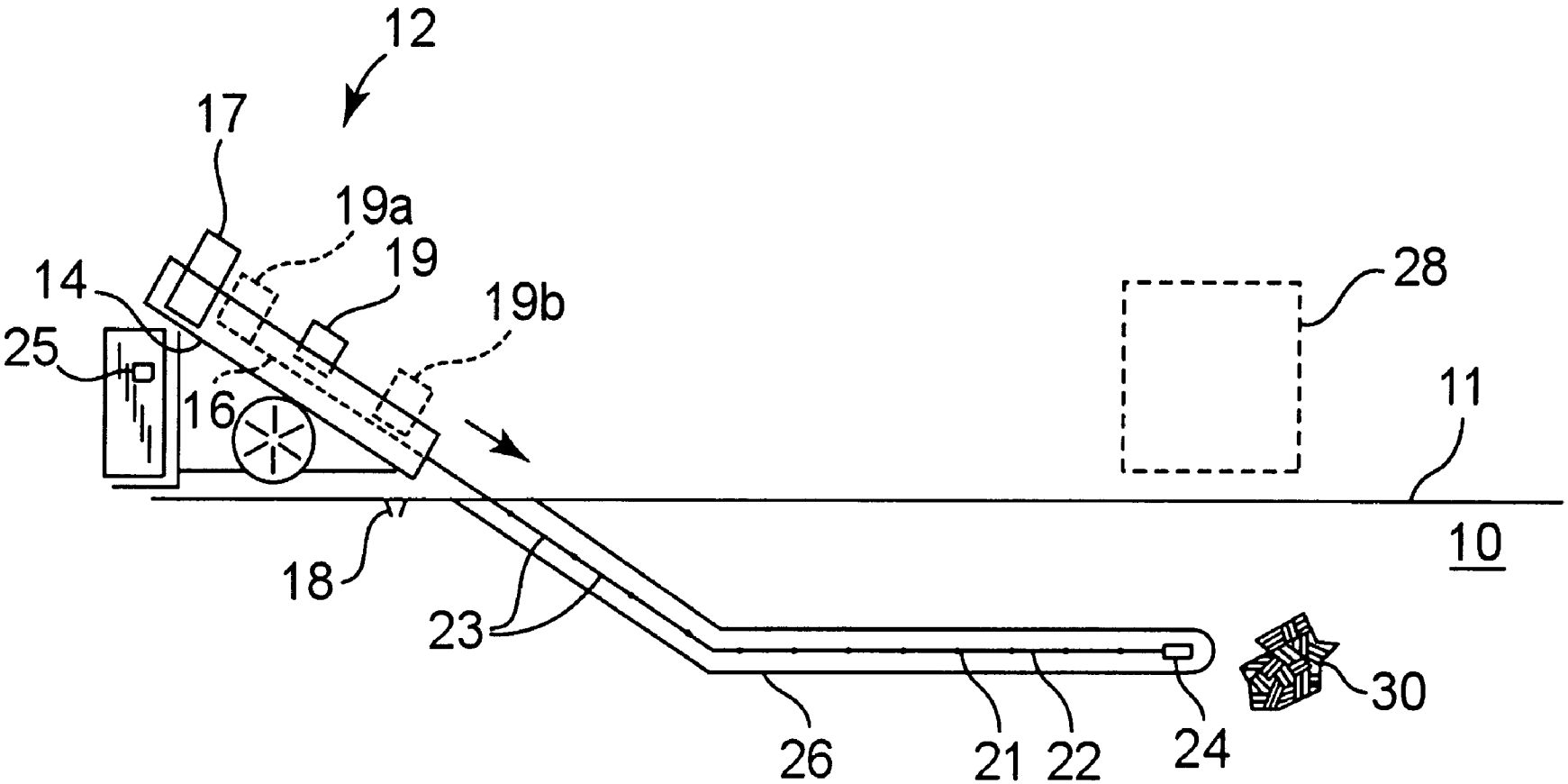
FIG. 1 illustrates various components of a drilling system and a ground cross section showing down hole boring components in accordance with various embodiments of this disclosure.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF VARIOUS EMBODIMENTS

Conventional horizontal directional drilling (HDD) requires at least one human operator controlling operation of the drill rig. Even though the use of bore plans has aided drill operation, an operator is still required to monitor drilling progress via gauges and other means and make adjustments. For example, even though a bore plan may specify a curve along a planned path for a boring tool, as well as parameters to guide the boring tool along that path, unexpected soil conditions, utility crossings and the like requires a human operator to manage drilling procedures by monitoring various metrics and implementing drill procedure changes.

Various drilling procedures are used for conducting HDD boring operation. Each boring procedure is composed of a combination of actions, each procedure designed to perform a particular maneuver. For example, a boring tool may be forced through the soil by pressure applied to the drill string at the rig, without rotation of the drill string. Such operation can be ideal for turning in relatively soft material due to the shape of the drill head, and may be determined to be suitable for drilling through a first leg of the boring plan containing a known soil type. However, the boring tool can advance and turn in a second leg of the boring plan to regions where the soil type is unknown, different, and considerably harder than the known soil type of the first leg. In this second leg, the boring tool may not be able to advance and/or turn efficiently, or at all, using the procedure employed in the first leg for advancing the boring tool along a turning path (pressure applied to the drill string at the rig without rotation of the drill string). In conventional HDD, a human operator would then need to change the drilling procedure to a mode more appropriate for the soil type of the second leg to complete the turning maneuver. Because the soil type of the second leg is unknown, the human operator will use his or her expertise to determine what alternative drilling procedure will be effective and efficient in boring through the soil of the second leg only once the soil type of the second leg is actually encountered.

Many different boring actions can be taken during a boring procedure for effectively and efficiently advancing the boring tool along a curve of a boring plan path. Such actions include increasing or decreasing pressure on the drill string (push pressure), clockwise rotation or counterclockwise rotation of the drill string and boring tool, and increasing or decreasing mud flow, among others. These actions can be performed in various combinations to provide a great variety of different turning maneuvers available to a drill operator. Therefore, a competent drill rig operator must be knowledgeable in not only how to perform each of the available maneuvers, but also knowledgeable in determining what particular maneuver is appropriate for each set of operating conditions and when to switch from employing one maneuver to another. The result is that proper HHD requires at least one highly skilled human operator actively monitoring the HDD operations at all times. The attention required by a highly skilled human HDD operator substantially increases drilling costs, and can distract from other important HDD operations, such as active obstacle detection. Moreover, a skilled HDD rig operator may not always be able to quickly detect changes in soil conditions and drill string/boring tool dynamics, whereby use of a different drilling procedure would be more effective and/or efficient.

Apparatuses and methods of the present invention address many of the complications encountered in conventional HDD procedures. For example, apparatuses and methods of the present invention can provide for determining when a presently employed boring procedure is suboptimal for the particular soil type being encountered, selecting which procedure from a plurality of procedures would be more suitable, and changing the procedure to improve drilling effectiveness and/or efficiency for the particular soil type being encountered.

In some embodiments of the invention, various parameters are monitored during boring along a curved path. An example of a monitored parameter can be, for example, drill string curvature. When one or more of these parameters exceeds a threshold or otherwise indicates undesirable drilling conditions, the drilling procedure currently used can be switched to another drilling procedure. In some embodiments of the invention, the switch from one drilling procedure to another is done automatically with no human intervention, facilitated by a processor executing program instructions stored in memory. However, in some embodiments of the invention, a human operator is prompted (via display, audible signal, etc.) to change the currently used drilling procedure.

FIG. 1 illustrates a cross-section through a portion of ground 10 where a boring operation takes place. The underground boring system, generally shown as the machine 12, is situated aboveground 11 and includes a platform 14 on which is situated a tilted longitudinal member 16. The platform 14 is secured to the ground by pins 18 or other restraining members in order to resist platform 14 movement during the boring operation. Located on the longitudinal member 16 is a thrust/pullback pump 17 for driving a drill string 22 in a forward, longitudinal direction as generally shown by the arrow. The drill string 22 is made up of a number of drill string members 23 attached end-to-end. Also located on the tilted longitudinal member 16, and mounted to permit movement along the longitudinal member 16, is a rotation motor or pump 19 for rotating the drill string 22 (illustrated in an intermediate position between an upper position 19*a* and a lower position 19*b*). In operation, the rotation motor 19 rotates the drill string 22 which has a boring tool 24 attached at the end of the drill string 22.

A tracker unit 28 may be employed to receive an information signal transmitted from boring tool 24 which, in turn, communicates the information signal or a modified form of the signal to a receiver situated at the boring machine 12. The boring machine 12 may also include a transmitter or transceiver for purposes of transmitting and/or receiving an information signal, such as an instruction signal, from the boring machine 12 to the tracker unit 28. Transmission of data and instructions may alternatively be facilitated through use of a communication link established between the boring tool 24 and central processor 25 via the drill string 22.

A boring operation can take place as follows. The rotation motor 19 is initially positioned in an upper location 19*a* and rotates the drill string 22. While the boring tool 24 is rotated through rotation of the drill string 22, the rotation motor 19 and drill string 22 are pushed in a forward direction by the thrust/pullback pump 17 toward a lower position into the ground, thus creating a borehole 26. The rotation motor 19 reaches a lower position 19*b* when the drill string 22 has been pushed into the borehole 26 by the length of one drill string member 23. A new drill string member 23 is then added to the drill string 22 either manually or automatically, and the rotation motor 19 is released and pulled back to the upper location 19*a*. The rotation motor 19 is used to thread the new drill string member 23 to the drill string 22, and the rotation/push process is repeated so as to force the newly lengthened drill string 22 further into the ground, thereby extending the borehole 26. Commonly, water or other fluid is pumped through the drill string 22 (refereed to herein as mud) by use of a mud or water pump. If an air hammer is used, an air compressor is used to force air/foam through the drill string 22. The mud or air/foam flows back up through the borehole 26 to remove cuttings, dirt, and other debris and improve boring effectiveness and/or efficiency. A directional steering capability is typically provided for controlling the direction of the boring tool 24, such that a desired direction can be imparted to the resulting borehole 26.

By these actions, and various combinations of these basic actions, a boring procedure can advance a boring tool 24 through soil, including advancing the boring tool 24 through a turn. A human operator can monitor various metrics to select the appropriate combinations of these actions to execute desired maneuvers and direct the boring tool 24 along a bore path. During execution of these boring procedures the human operator must continue to monitor soil conditions to decide when to change procedures to optimize boring efficiency. For example, hard soil patch 30 can be much denser then the surrounding soil. When the boring tool 24 encounters hard soil patch 30 a previously used boring procedure may be relatively unproductive or even ineffective in making progress. Embodiments of the present disclosure provide for apparatuses and methods for monitoring of boring parameters and automatic optimization of boring procedures while performing turning boring maneuvers, among others things.

As discussed above, various actions related to controlling boring can be combined to create boring procedures which perform specific maneuvers. The variety of different procedures allows for maneuvers for specific operations, each procedure suited for a particular maneuver. For example, turning in soft soil of a certain type can be most efficiently performed using one procedure while turning in hard soil of a certain type can be most efficiently performed using a different procedure.

A basic boring action is applying pressure on a boring tool, which can advance the boring tool through soil along a curved path as the face of the boring tool uses soil to bank. The pressure can be supplied by a thrusting/pullback pump using hydraulics. The force is then transferred through a drill string to the boring tool. Generally, boring tool advancement is related to the pressure applied and soil softness. Accordingly, relatively high pressure applied by a thrust pump on a rig can result in a fast push of the drill string and relatively low pressure applied by the thrust pump on the rig can lead to a slow push of the drill string and boring tool.

A rotation pump on a drill rig can be used to rotate a drill string, which can rotate a boring tool. Rotation of the boring tool can carve through soil, allowing the boring tool to advance if a sufficient thrusting force is applied through the drill string.

Continuous 360 degree rotation of the boring tool will generally carve a straight path through soil. The boring tool can be turned to carve a curving path by combinations of various actions. For example, the boring tool can be quickly and repeatedly rotated through small angle counterclockwise (CCW) and clockwise (CW) rotations such that the boring tool never makes a complete rotation (referred to as a "wiggle"). Many boring tool bits are configured such that the bits make the greatest cut of soil when rotated in one direction, either CW or CWW. Therefore, wiggling (or any rotation/counter rotation) allows the bit of a boring tool to repeatedly rotate over a portion of the boring path, carving out that portion, whereby if the boring tool is going to advance under a thrusting force, it will advance in the direction of the carved out portion.

The boring tool is typically rotated through relatively small CW and CCW angles while wiggling. However, other procedures involving repeated CW and CCW rotation can be performed over larger angles, and other modifications are also contemplated. For example, thrust pressure can be applied through the drill string while the boring tool is rotated through a CW angle, but not applied when the boring tool is rotated through a CCW angle. Also, thrust pressure can be applied through the drill string while the boring tool is rotated through a CW angle, and retraction pressure (pulling the boring too back slightly) can be applied when the boring tool is rotated through a CCW angle. Lack of thrust pressure, or actual retraction of a boring tool, while the boring tool is rotated through the angle in which the bit typically does not make a cut in the soil can allow the soil face previously cut to remain relatively undisturbed before the next cut is made.

In accordance with another steering procedure of the present disclosure which employs a rockfire cutting action, the boring tool is thrust forward until the boring tool begins its cutting action. Forward thrusting of the boring tool continues until a preset pressure for the soil conditions is met. The boring tool is then rotated clockwise through a cutting duration while maintaining the preset pressure. In the context of a rockfire cutting technique, the term pressure refers to a combination of torque and thrust on the boring tool. Clockwise rotation of the boring tool is terminated at the end of the cutting duration and the boring tool is pulled back until the pressure at the boring tool is zero. The boring tool is then rotated clockwise to the beginning of the duration. This process is repeated until the desired boring tool heading is achieved.

Boring procedures can include the delivery of a fluid, such as a mud and water mixture or an air and foam mixture, to the boring tool during excavation. A human operator and/or a central processor, typically in cooperation with a machine controller, can control various fluid delivery parameters, such as fluid volume delivered to the boring tool and fluid pressure and temperature for example. The viscosity of the fluid delivered to the boring tool can similarly be controlled, as well as the composition of the fluid. For example, a rig controller may modify fluid composition by controlling the type and amount of solid or slurry material that is added to the fluid. The composition of the fluid delivered to the boring tool may be selected based on the composition of soil/rock subjected to drilling and appropriately modified in response to encountering varying soil/rock types at a given boring site. Additionally, the composition of the fluid may be selected based upon the changes in parameter values, such as drill string rotation torque or thrust/pullback force, for example.

The delivery of fluid through the bore is not always necessary for efficient boring, particularly in soft soil. In such cases, it is desirable not to needlessly expend resources delivering fluid through the bore. Traditionally, a human operator has been required to determine when the delivery of fluid is necessary for efficient boring. However, embodiments of the current invention can facilitate selection and modification of boring procedures, including determining when fluid should be delivered.

Boring actions can also include modification of the configuration of the boring tool. The configuration of the boring tool according to soil/rock type and boring tool steering/productivity requirements can be controlled to optimize boring efficiency. One or more actuatable elements of the boring tool, such as controllable plates, duckbill, cutting bits, fluid jets, and other earth engaging/penetrating portions of the boring tool, may be controlled to enhance the steering and cutting characteristics of the boring tool. In an embodiment that employs an articulated drill head, a central processor may modify the head position, such as by communicating control signals to a stepper motor that effects head rotation, and/or speed of the cutting heads to enhance the steering and cutting characteristics of the articulated drill head. The pressure and volume of fluid supplied to a fluid hammer type boring tool, which is particularly useful when drilling through rock, may be modified.

Various basic actions, such as those discussed above, can be combined in the manner discussed above, or in other combinations, to perform a plurality of different boring procedures. A variety of different procedures can be useful to optimize boring efficiency, as different boring procedures will have different productivity levels across different soil types. Table 1 provides one example of a hierarchy of boring procedures.

TABLE 1

| BORING PROCEDURE HIERARCHY |
|---|
| 1. Fast Push |
| 2. Slow push with mudflow |
| 3. Push with high mudflow |
| 4. Slow push with high mudflow and wiggling rotation |
| 5. Slow push with high mud flow and repeated CW and CCW rotation |
| 6. High mudflow, repeated slow push during CW rotation, slight retraction of drill string, and CCW when retracted |
| 7. High mudflow, repeated slow push during CW rotation and no push during CCW rotation |

Table 1 represents a hierarchy of boring procedures according to various embodiments of the current invention. This hierarchy can represent various procedures arranged in an order of increasing ability to bore through hard soil. For example, procedure 1 may be the most efficient in soft soil, but ineffective at boring through harder soil. Procedure 5 may be effective at boring through the same soft soil, but because of the slow push, rotation, and mudflow, is less productive, efficient and needlessly expends resources in the soft soil relative to procedure 1. Therefore, as long as procedure 1 is effective and efficient, it is preferable to operate using procedure 1.

However, it is expected that boring operations will encounter soil conditions much harder than the soft soil conditions ideal for procedure 1. The less efficient, but more effective procedures of the higher procedure numbers are more appropriate for these harder soil conditions. When encountering these situations, particularly in areas where the soil hardness is transitioning, it is important to drilling efficiency to switch to the appropriate procedure (number). Accordingly, an efficient drilling operation should be able to determine when a current boring procedure is suboptimal and switch to a more appropriate boring procedure.

As can be seen from Table 1, the differences between boring procedures comprise operational changes in boring procedure, and not merely an adjustment in an output parameter, such as thrust. For example, the step between procedures 1 and 2 requires both a thrust change and the introduction of mudflow. The step between procedures 2 and 3 requires both a thrust change and a mudflow change. Later steps introduce different pipe rotation operations as well as changes in thrust and mudflow. As such, a hierarchy of boring procedures includes a plurality of whole individual boring procedures each composed of a different combination of boring actions arranged in a manner to facilitate boring procedure reconfiguration, and does not represent mere parameter adjustment in the face of boring resistance.

One challenge in achieving efficient boring is determining when to switch boring procedures. Indicators of boring inefficiency can include slow or no forward axial movement, high rotational travel of the drill string, high hydraulic pressure in drill rig, rig vibration, and high tensional pressure of drill string, among others. Pushback, where the drill rig pushes on a slow moving or non-moving drill string so hard that the drill rig displaces itself, can also be an indicator of boring inefficiency. High or low stress and/or strain in components beyond an expended range, such as the drill string, drill head, thrust components (e.g., push rod or bracket), and/or rotation components, can indicate a currently used boring procedure is suboptimal for current soil conditions. The parameters discussed above can be used as discussed herein, such as in the methods of FIGS. 2 and 3, to determine when to switch boring procedures to optimize boring efficiency.

Various sensors can be used to sense and monitor the parameters discussed herein. For example, a pressure sensor can sense hydraulic pressure. A strain gauge can measure component stress/strain. Pushback can be sensed using inclinometers, accelerometers, and ultrasonic transducers, among other sensors.

Figure 2:
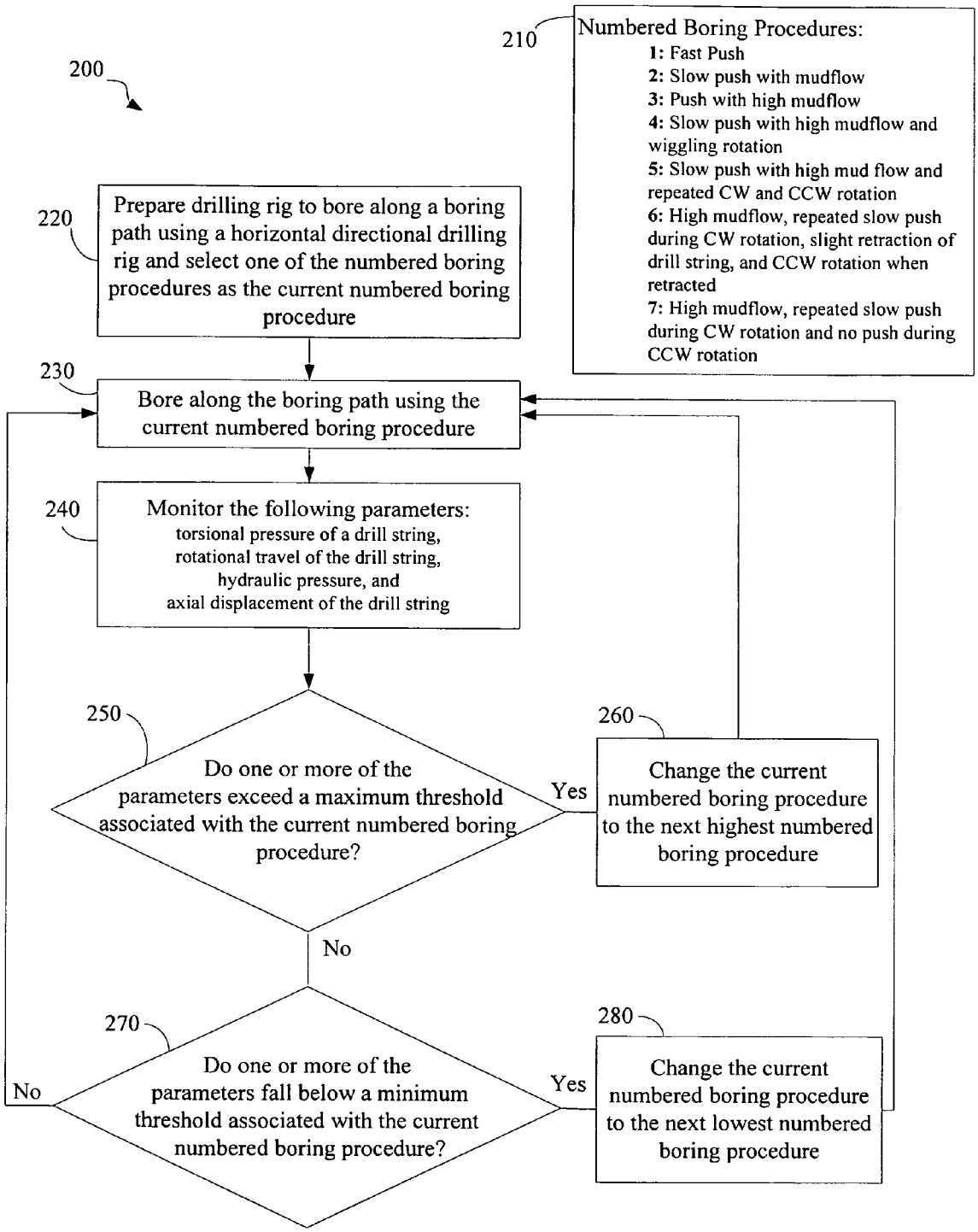
FIG. 2 illustrates a flow chart for carrying out dynamic boring procedure reconfiguration in accordance with various embodiments of this disclosure.

FIG. 2 illustrates a flow chart 200 for performing a curved path boring procedure. Associated with the flow chart 200 is a hierarchy of boring procedures 210. The hierarchy 210 comprises 7 different boring procedures. The procedures of the hierarchy 210 are hierarchically arranged such that the low numbers bore through soft soil most efficiently and the higher numbers bore through hard soil most efficiently.

The method of the flow chart 200 begins with preparing 220 a drilling rig to bore along a boring path using a HDD rig and selecting one of the numbered boring procedures as the current numbered boring procedure. Preparing 220 may also include forming or accessing a bore plan, positioning the rig and boring components, and testing soiling conditions.

Preparing 220 includes selecting one of the numbered boring procedures as the current numbered procedure. In some embodiments, the Procedure 2 (slow push with mudflow) will automatically be selected, while in other embodiments a procedure number will be selected based on the procedure appropriate for the known conditions. For example, an initial current boring procedure can be selected by determining the soil characteristics of the soil first encountered. A boring system may include one or more of geophysical sensors, including a GPR imaging unit, a capacitive sensor, acoustic sensor, ultrasonic sensor, seismic sensor, load point tester, Schmidt hammer, resistive sensor, and electromagnetic sensor, for example, to determine the soil characteristics of the soil first encountered. In accordance with various embodiments, surveying the boring site, either prior to or during the boring operation, with geophysical sensors provides for the production of data representative of various characteristics of the ground medium subjected to the survey. The ground characteristic data acquired by the geophysical sensors during the survey may be processed by a processor, which may be used to select and later modify a boring procedure. For example, if the survey indicates that the soil is relatively soft, then a boring procedure most efficient for soft soil may be initially selected (such as Procedure 1 or 2).

The method of the flow chart 200 further includes boring 230 along the bore path using the current numbered boring procedure. For example, if Procedure 1 was selected in step 220 as the current numbered boring procedure, the boring 230 will be conducted by a fast push of the drill string with no mudflow or drill string rotation.

While boring 230, the method also monitors 240 various parameters, including torsional pressure of a drill string, rotational travel of the drill string, hydraulic pressure, and axial displacement of the drill string. If, during monitoring 240, it is determined 250 that one or more of the parameters exceeds a maximum threshold associated with the current numbered boring procedure, then the method advances to step 260. In the particular embodiment of FIG. 2, each of the numbered boring procedures of the hierarchy 210 includes an associated maximum and minimum threshold for one or more of the parameters. For example, if the current numbered boring procedure is Procedure 1, the maximum threshold can be a pressure value measured in lbs./in$^2$, whereby if the monitored hydraulic pressure exceeds this value, then the threshold of decision block 250 is exceeded and the method advances to block 260. If no parameter threshold is exceeded, then the method advances to block 270.

Different threshold values may be implemented for each numbered boring procedure of the hierarchy 210. For example, Procedure 5, which is expected to be better adapted to operate in harder soil conditions, may typically operate with higher hydraulic pressures, and thus will have a higher parameter threshold for hydraulic pressure, as compared to Procedure 1. In some configurations, the opposite is true (Procedure 1 is associated with higher operating hydraulic pressures compared to Procedure 5), and in some configurations, minimum thresholds will also vary between numbered boring procedures of the hierarchy 210 for similar reasons. Custom parameter thresholds can be established for each procedure of the hierarchy, or each procedure of the hierarchy can have the same parameter threshold value. As such, procedure 1 can have predetermined maximum and minimum thresholds measured in lbs./in$^2$ while the other procedures can then have different pressure values measured in lbs./in$^2$ customized for what would be an appropriate range of pressure for each particular procedure. If the maximum is exceeded, then the high pressure indicates that the current boring procedure is not properly geared for such hard soil, and a switch can be made to the next higher procedure. If a parameter such as pressure falls below a minimum, then the low pressure indicates that the current boring procedure is geared to handle harder soil and could move faster or more efficiently using a lower ranked procedure.

If the method advances to step 260, the number of the current numbered boring procedure is incremented, such that if Procedure 3 was the current numbered boring procedure in step 250, Procedure 4 will then be the current numbered boring procedure. In this way, embodiments of the current invention can automatically adjust to changing soil conditions and find the appropriate drilling procedure.

If a threshold of step 250 is not exceeded by a monitored 240 parameter, then the method determines 270 whether one or more of the parameters fall below a minimum threshold associated with the current numbered boring procedure. A monitored 240 parameter falling below a minimum threshold can indicate that a procedure geared toward boring through hard soil is not encountering high resistance, meaning a lowered numbered procedure of the hierarchy 210 may be able to bore through the same soil more efficiently (e.g., faster) than the numbered boring procedure currently being used.

If it is determined that 270 one or more minimum thresholds are not met by the monitored 240 parameters, then the method advances to step 280. If the method advances to step 280, the number of the current numbered boring procedure is decremented, such that if Procedure 7 was the current numbered boring procedure in step 270, Procedure 6 will then be the current numbered boring procedure.

If the monitored 240 parameters are within the thresholds of steps 250 and 270, then boring 230 continues.

Although torsional pressure of a drill string, rotational travel of the drill string, hydraulic pressure, and axial displacement of the drill string parameters are discussed in connection with FIG. 2, other parameters could instead, or additionally, be used. For example, in some embodiments drill string curvature is monitored as a parameter and changes in boring procedure in accordance with a hierarchy can be made based on measured drill string curvature falling below a minimum threshold (too shallow a curve as compared to a bore plan, indicating need for more effective turning procedure, such as a higher ordered procedure of a hierarchy) or exceeding a maximum threshold (too sharp a curve as compared to a bore plan, indicating need for less aggressive turning procedure, such as a lowered ordered procedure of a hierarchy).

Various parameters can be monitored while boring, the parameter values being useful to optimize boring procedures in accordance with embodiments of the current invention. Parameters can be placed into at least two different categories, the at least two different categories including progress parameters and operational parameters.

Progress parameters are characterized by a displacement or other metric associated with boring progress. For example, the longitudinal displacement of the boring tool, drill string, and/or gear box can be monitored as a progress parameter. Displacement could be linear, or could be displacement along a curved path, such as turning angle, radius of curvature of a curve, progress along a planned curved path, etc of various components, such as a drill head. Displacement of the boring tool, drill string, drill head, and/or gear box can be measured using techniques understood in the art.

Other progress parameters include cuttings size, type, and weight. For example, a measurement of cutting returns received exiting a bore hole can indicate how much progress is being made by the current boring procedure. More cuttings are generally associated with greater productivity while fewer cuttings are associated with less productivity. Therefore, a cuttings measurement (e.g., volume or weight) indicating a level of cuttings below a cuttings threshold can be used to trigger a change in boring procedure to a different procedure from a hierarchy. If it is unclear whether a small amount of cuttings are due to the soil being too hard for the current boring procedure or the current boring procedure being geared for harder soil while operating in soft soil, then another parameter, such as hydraulic fluid pressure in the pump can be used to determine whether a faster or slower procedure should be used next. For example, higher hydraulic fluid pressure can indicate the soil is hard relative to the current boring procedure requiring a switch to a higher ordered boring procedure while a lower hydraulic fluid pressure can indicate that the soil is soft relative to the current boring procedure geared for harder soil requiring a switch to a lower ordered boring procedure.

Operational parameters are characterized by a status metric relating, for example, the status of a component of a drill rig, drill string, or boring tool. Returning to FIG. 1, the boring tool 24 can be moved by the thrust/pullback pump 17 applying pressure on the drill string 22. The thrust/pullback pump 17 can apply such pressure by use of hydraulics. The hydraulic pressure in the thrust/pullback pump 17, as well as the hydraulic pressure of other pumps and components using in boring, can be used as an operational parameter.

If a screw design is used to move the drill string 22, than the strain in the drill string 22 or other component, as measured by a strain gauge, can be used as an operational parameter. Relatively high measurements from a strain gauge can indicate that a current boring procedure is having difficulty cutting and turning because the soil is hard relative to the currently employed boring procedure. In this case, a switch can be made to a higher ordered boring procedure geared for harder soil. Likewise, relatively low stress measurements can indicate that a current boring procedure is geared for harder soil and that a lower ordered boring procedure could make progress faster and/or with less resource expenditure.

Other operational parameters include rotation pump pressure, torque imparted to the drill string via the rotation pump, differential in gearbox and boring tool rotation (torsional windup), rig movement relative to the ground, mud pressure, mud weight (flow), vibration magnitude and frequency of various components (e.g., drill stem, pump, motor, chassis), engine loading, and moments in the gear box (e.g., caused by rotation or the force acting perpendicular to the direction of thrust), among others that will be apparent to one of ordinary skill in the art upon reading this disclosure.

Operational parameters can indicate that a currently used boring procedure is ineffective at boring through soil, creating stress on rig components. For example, high pump pressure can indicate that the drill head cannot be moved or rotated commiserate with the axial or rotational thrust applied. As such, high measures (e.g., above a maximum threshold) of one or more operational parameters can indicate a more aggressive procedure would be more effective for the soil conditions. Also, it is expected that some stress should be present with boring. Therefore, low measures (e.g., below a threshold) of one or more operational parameters can indicate that a less aggressive procedure would be equally effective or even more productive for the soil conditions.

An operational parameter may be calculated from measured values, such as the rate of change of any of the operational parameters discussed herein. For example, an operational parameter may be the rate of change of hydraulic pressure in the thrust/pullback pump 17.

Various types of sensors may be employed to measure parameters. For example, known types of vibration sensors/transducers may be employed, including single or multiple accelerometers, for example.

As demonstrated in Fig, 2, parameters can be used to select and/or change a boring procedure. However, a further aspect of the current invention includes using comparisons between parameters to select and/or change boring procedures to optimize boring efficiency. For example, a comparison can be made between drill stem displacement (advancement) and hydraulic pressure in a thrust pump. Such a comparison can determine a parameter comparison value. For this particular example, the parameter comparison value could be measured in inches/PSI. A similar comparison could be made of the rate of displacement of, for example, the boring tool and rotational pump pressure, measured in (feet/min)/PSI. These and other parameter comparison values provide information concerning progress and effort. Embodiments of the present invention provide that when the ratio of progress to effort falls outside of a range (e.g., exceeds a high or low threshold), a change in boring procedure can be implemented to a more or less aggressive procedure.

Parameter comparison values can be calculated by dividing any progress parameter referenced herein by any operational parameter discussed herein to yield a metric representative of progress vs. effort or rig stress. A change in boring procedure based on parameter comparison values can be done accordingly to the hierarchal methods discussed herein.

Figure 3:
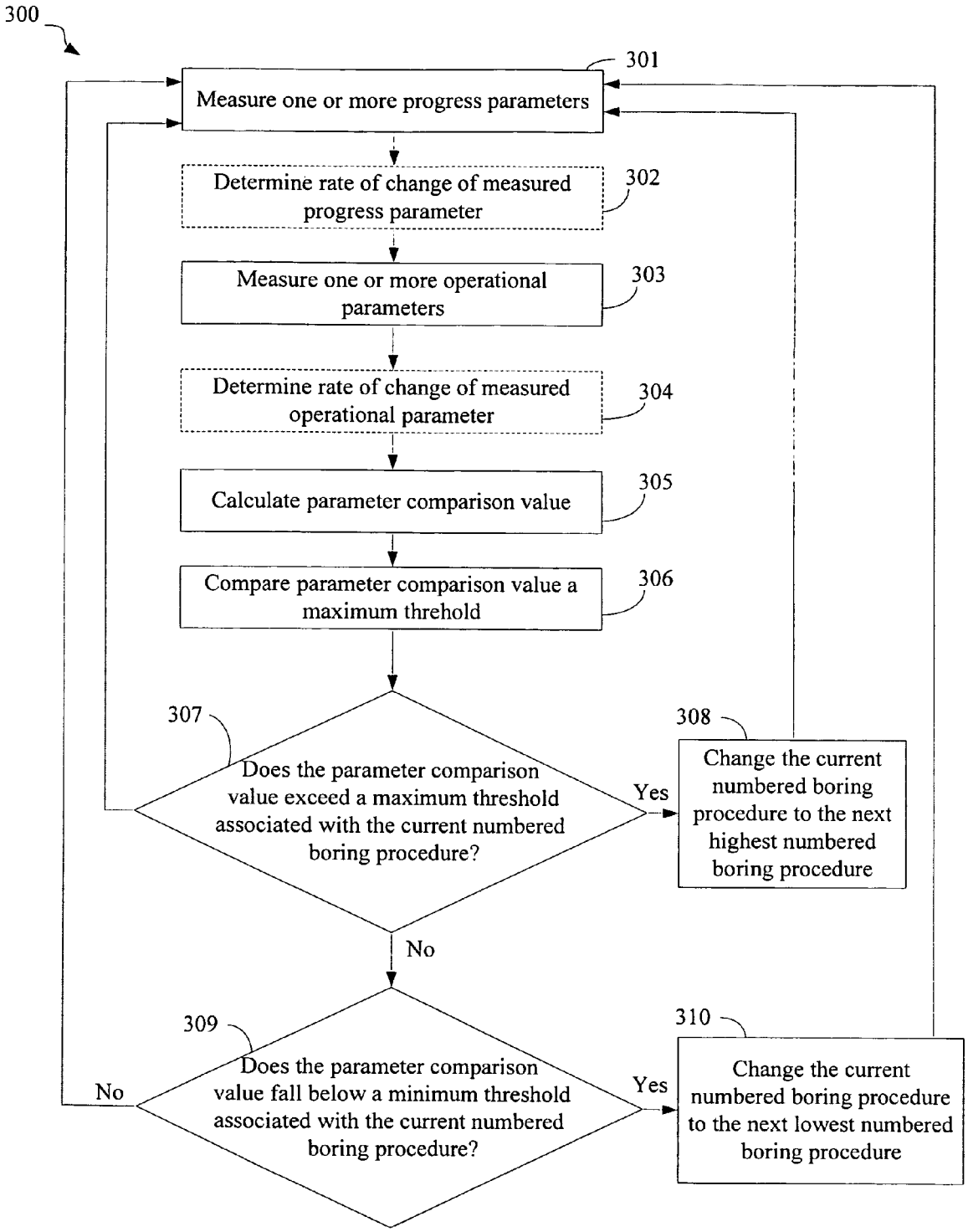
FIG. 3 illustrates another flow chart for carrying out dynamic boring procedure reconfiguration in accordance with various embodiments of this disclosure.

FIG. 3 illustrates a method for changing a boring procedure. While boring, one or more progress parameters are measured 301. Optionally, a rate of change of the measured progress parameter is determined 302. If, for example, the progress parameter is boring tool advancement, then the determined 302 rate of change of this parameter could be a velocity or acceleration of the boring tool. The other parameters mentioned herein that can be measured in rate of change can similarly be used with various embodiments of the present invention.

The method of FIG. 3 includes measuring 303 one or more operational parameters. Optionally, a rate of change of the measured one or more operational parameters can be determined 304. If, for example, the progress parameter is drill rig displacement, then the determined rate of change of the one or more operational parameters could be a velocity or acceleration of the drill rig.

The method of FIG. 3 further includes calculating 305 a parameter comparison value. The parameter comparison value could be a comparison of any of the values measured or calculated in steps 301-304. The comparison value could be, for example, calculated by dividing the velocity of the drilling rig with the velocity of the boring tool. In this way, a relatively high parameter comparison value could mean that the drilling rig was moving relatively quickly compared with the movement of the boring tool. Alternatively, any of progress parameters (e.g., drill head advancement) could be divided by any of the operational parameters (e.g., pump hydraulic pressure, rig vibration, component stress and/or strain) to yield a parameter comparison value indicating progress compared to machine stress. A parameter comparison value indicating progress compared to machine stress can then be compared to one or more thresholds to determine whether a switch to another boring procedure would likely yield better progress compared to machine stress results.

If the parameter comparison value exceeds a maximum threshold associated with a current numbered boring procedure 307, then the current numbered boring procedure can be changed 308 to a next highest numbered boring procedure, and boring continued. A boring procedure hierarchy could be made for the embodiment of FIG. 3 using any combination of the boring procedures discussed herein, including the boring procedure hierarchy of FIG. 3.

Continuing with the example discussed above, if the drill rig was moving relatively quickly in comparison to the velocity of the boring tool, then the next highest numbered boring procedure of the boring procedure hierarchy can be used. Therefore, if the boring procedures are arranged with increasing ability to bore through hard soil, then the change to the next highest numbered boring procedure can increasing the productivity of boring, as a high amount of drill rig displacement compared to boring tool displacement (or velocity) can indicate a lack of progress compared with effort expended and that another procedure could be more appropriate.

If, in the evaluation step of 307, the parameter comparison value does not exceed a maximum threshold associated with a current numbered boring procedure 307, then the method proceeds to the evaluation step 309. Evaluation step 309 evaluates whether the parameter comparison value falls below a minimum threshold. If the parameter comparison value falls below the minimum threshold, then the current numbered boring procedure is changed 310 to the next lowest numbered boring procedure. In some embodiments, the higher numbered boring procedures can expend more resources than the lower numbered boring procedures (e.g., mud used) or run at a slower pace. Therefore, if insufficient progress is being made compared to the effort expended, as reflected by the parameter comparison value, then a lowered numbered boring procedure may be more appropriate. For example, a boring procedure may be performing repeated CW and CCW rotations while experiencing little resistance in the soil (as measured by the hydraulic pressure of the thrusting pump, for example), where a boring procedure that did not use counter rotation may make as much progress or more progress without taking the time or resources for counter rotations.

Boring tool sensor data can acquired during the boring operation in real-time from various sensors provided in a down-hole sensor unit at the boring tool. Such sensors can include a triad or three-axis accelerometer, a three-axis magnetometer, and a number of environmental and geophysical sensors to calculate the various parameters discussed herein. The acquired data is communicated to a central processor via the drill string communication link or via an above-ground tracker unit.

Embodiments directed to the use of integral electrical drill stem elements for effecting communication of data between a boring tool and boring machine are disclosed in U.S. Pat. No. 6,367,564, which is hereby incorporated herein by reference in its entirety. A bore plan design methodology, and other components and techniques that can be used with embodiments of the present invention are disclosed in U.S. Pat. No. 6,389,360, which is hereby incorporated herein by reference in its entirety.

Collected orientation data typically, but not necessarily, includes the pitch, yaw, and roll (i.e., p, y, r) of the boring tool. Depending on a given application, it may also be desirable or required to acquire environmental data concerning the boring tool in real-time, such as boring tool temperature and stress/pressure, for example. Geophysical and/or geological data may also be acquired in real-time. Data concerning the operation of the boring machine can also be acquired in real-time, such as pump/motor/engine productivity or pressure, temperature, stress (e.g., vibration), torque, speed, etc., data concerning mud/air/foam flow, composition, and delivery, and other information associated with operation of the boring system. The procedures discussed herein for boring procedure optimization can use these parameters to determine when to switch to a higher or lower ordered boring procedure.

A walkover tracker or locator may be used in cooperation with the magnetometers of the boring tool to confirm the accuracy of the trajectory of the boring tool and/or bore path and calculate the various parameters discussed herein, such as drill string curvature or boring tool velocity.

By way of example, one system embodiment employs a conventional sonde-type transmitter in the boring tool and a portable remote control unit that employs a traditional methodology for locating the boring tool. A Global Positioning System (GPS) unit or laser unit may also be incorporated into the remote control unit to provide a comparison between actual and predetermined boring tool/operator locations.

The displacement of a boring tool can be computed and acquired in real-time by use of a known technique, such as by monitoring coordinates of a boring tool relative to a fixed point, accelerometer data collected or time indicated overall movement and direction, and/or the cumulative length of drill rods of known length added to the drill string during the boring operation.

Figure 4:
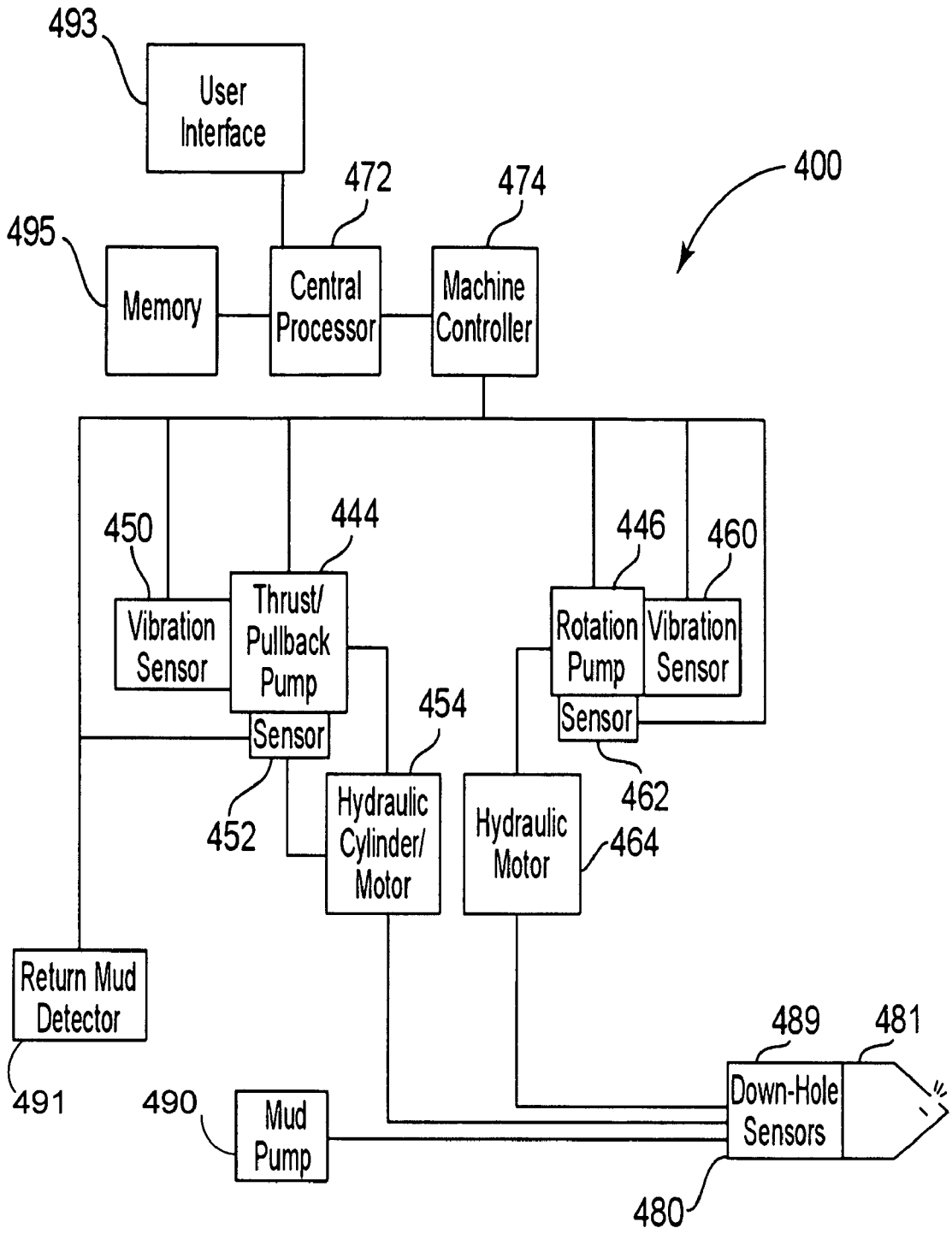
FIG. 4 illustrates a block diagram of a drilling system circuitry and components for carrying out dynamic boring procedure reconfiguration in accordance with various embodiments of this disclosure.

FIG. 4 illustrates various aspects of control circuitry and components for implementing various embodiments of the inventions. FIG. 4 includes sensors for determining various progress and operational parameters, circuitry for comparing the parameters to thresholds and determining whether to change boring procedures, circuitry for selecting a boring procedure from a hierarchy of boring procedures, and components for implementing a boring procedure change.

The boring machine 400 of FIG. 4 includes down-hole sensor unit 489 proximate the boring tool 481. Using the data received from the down-hole sensor unit 489 at the boring tool 481 and, if desired, drill string displacement data, the central processor 472 computes the range and position of the boring tool 481 relative to a ground level or other pre-established reference location. The central processor 472 may also compute the absolute position and elevation of the boring tool 481, such as by use of known GPS-like techniques. Using the boring tool data the central processor 472 also computes one or more of the pitch, yaw, and roll (p, y, r) of the boring tool 481. Depth of the boring tool may also be determined based on the strength of an electromagnetic sonde signal transmitted from the boring tool. It is noted that pitch, yaw, and roll may also be computed by the down-hole sensor unit 489, alone or in cooperation with the central processor 472. Suitable techniques for determining the position and/or orientation of the boring tool 481 may involve the reception of a sonde-type telemetry signal (e.g., radio frequency (RF), magnetic, or acoustic signal) transmitted from the down-hole sensor unit 489 of the boring tool 481. Such information can be used to calculate the various parameters discussed herein, such a progress parameters.

The thrust/pullback pump 444 depicted in FIG. 4 drives a hydraulic cylinder 454, or a hydraulic motor, which applies an axially directed force to a length of pipe 480 in either a forward or reverse axial direction. The thrust/pullback pump 444 provides varying levels of controlled force when thrusting a length of pipe 480 into the ground to create a borehole and when pulling back on the pipe length 480 when extracting the pipe 480 from the borehole during a back reaming operation. The rotation pump 446, which drives a rotation motor 464, provides varying levels of controlled rotation to a length of the pipe 480 as the pipe length 480 is thrust into a borehole when operating the boring machine in a drilling mode of operation, and for rotating the pipe length 480 when extracting the pipe 480 from the borehole when operating the boring machine in a back reaming mode.

Sensors 452 and 462 can monitor the pressure of the thrust/pullback pump 844 and rotation pump 446, among other things. Sensors 452 and 462 can be attached, or located proximate to a drill rig and monitor various parameters concerning boring discussed herein, including operational parameters. For example, sensors 452 and 462 may contain accelerometers and/or ultrasonic elements to sense drill rig displacement in 1, 2, or, 3 dimensions. Down-hole sensors 489 can measure various parameters discussed herein, including progress and operational parameters. Signals generated by the sensors reflecting measurements can be transmitted to machine controller 474 and central processor 472. Machine controller 474 and/or central processor 472 can process the sensor signals and perform the various functions discussed herein, including derive parameter information, perform mathematical operations, determine rates of change of the signals, compare signals and/or parameters, and implement changes in boring operation, among other functions discussed herein or generally known.

The machine controller 474 also controls rotation pump movement when threading a length of pipe onto a drill string 480, such as by use of an automatic rod loader apparatus of the type disclosed in commonly assigned U.S. Pat. No. 5,556,253, which is hereby incorporated herein by reference in its entirety. An engine or motor (not shown) provides power, typically in the form of pressure, to both the thrust/pullback pump 444 and the rotation pump 446, although each of the pumps 444 and 446 may be powered by separate engines or motors.

Mud is pumped by mud pump 490 through the drill pipe 480 and boring tool 481 so as to flow into the borehole during respective drilling and reaming operations. The fluid flows out from the boring tool 481, up through the borehole, and emerges at the ground surface. The flow of fluid washes cuttings and other debris away from the boring tool 481 thereby permitting the boring tool 481 to operate unimpeded by such debris. The composition of mud (e.g., water-to-additive ratio) and quantify of mud pumped into a bore hole can be controlled by machine controller 474.

Return mud detector 491 can include one or more sensors for measuring the quantity of material removal from the bore hole (e.g., cuttings). For example, a above-ground scale or flow rate sensor in the bore hole can calculate the amount of mud exiting the bore hole and compare these measurements to the amount of mud pumped into the bore hole. The greater the difference can indicate a greater level of cuttings and a greater level of boring progress, which can be used to optimize boring operations in the manner discussed herein. The difference between mud in/mud out can also be divided by time to determine a material removal rate as a progress and efficiency parameter. Also, the rate of material removal from the borehole as a progress parameter, measured in volume per unit time, can be estimated by multiplying the displacement rate of the boring tool 481 by the cross-sectional area of the borehole produced by the boring tool 481 as it advances through the ground.

In accordance with one embodiment for controlling the boring machine using a closed-loop, real-time control methodology of the present disclosure, overall boring efficiency may be optimized by appropriately controlling the respective output levels of the rotation pump 446, mud pump 490, and the thrust/pullback pump 444, among other components contributing to drilling output. Under dynamically changing boring conditions, closed-loop control of the thrust/pullback and rotation pumps 444 and 846 provides for substantially increased boring efficiency over a manually controlled methodology. Within the context of a hydrostatically powered boring machine or, alternatively, one powered by proportional valve-controlled gear pumps or electric motors, increased boring efficiency is achievable by rotating the boring tool 481 at a selected rate, monitoring the pressure of the rotation pump 446, and modifying the rate of boring tool displacement in an axial direction with respect to an underground path while concurrently rotating the boring tool 481 at the selected output level in order to compensate for changes in the pressure of the rotation pump 446. Sensors 452 and 462 monitor the pressure of the thrust/pullback pump 444 and rotation pump 446, respectively.

In accordance with one mode of operation, an operator initially selects a boring procedure estimated to provide optimum boring efficiency. The rate at which the boring tool 481 is displaced along the underground path during drilling or back reaming for a given pressure applied through the drill string typically varies as a function of soil/rock conditions, length of drill pipe 480, fluid flow through the drill string 480 and boring tool 481, and other factors. Such variations in displacement rate typically result in corresponding changes in rotation and thrust/pullback pump pressures, as well as changes in engine/motor loading, among other parameters. Although the rotation and thrust/pullback pump controls permit an operator to modify the output of the thrust/pullback and rotation pumps 444 and 446 on a gross scale, those skilled in the art can appreciate the inability by even a highly skilled operator to quickly and optimally modify boring tool productivity under continuously changing soil/rock and loading conditions. As discussed above, embodiments of the present invention can address these and other problem by sensing suboptimal boring, selecting an appropriate boring procedure, and automatically change boring procedures to optimize boring efficiency.

A user interface 493 provides for interaction between an operator and the boring machine. The user interface 493 includes various manually-operable controls, gauges, readouts, and displays to effect communication of information and instructions between the operator and the boring machine.

The user interface 493 may include a display, such as a liquid crystal display (LCD) or active matrix display, alphanumeric display or cathode ray tube-type display (e.g., emissive display), for example. The interface 493 may visually communicate information concerning operating and sensed parameters and one or more boring procedures.

While some embodiments of the current disclosure have demonstrated how boring procedures could automatically be changed to optimizing boring efficiency, not all embodiments of the present disclosure are so limited. For example the user interface 493 may display information indicating that the central processor 472 has determined that a change in boring procedure would improve boring efficiency (such as to a higher or lowered number boring procedure as discussed above), and may further recommend a specific change in boring procedure. A human operator may then consider the information and implement the recommended change in boring procedure. Alternatively, a boring machine may be enabled to implement a change in boring procedure but require authorization from the user via the interface 493 before a boring procedure change is implemented.

Embodiments of the invention can use memory 495 coupled to the central processor 471 to perform the methods and functions described here. Memory can be a computer readable medium encoded with a computer program, software, computer executable instructions, instructions capable of being executed by a computer, etc, to be executed by circuitry, such as central processor and/or machine controller. For example, memory can be a computer readable medium storing a computer program, execution of the computer program by central processor causing reception of one or more signals from sensors, measurement of the signals, calculation using one or more algorithms, and outputting of a parameter according to the various methods and techniques made known or referenced by the present disclosure. In similar ways, the other methods and techniques discussed herein can be performed using the circuitry represented in FIG. 4.

The various processes illustrated and/or described herein (e.g., the processes of FIG. 2 and 3) can be performed using a single device embodiment (e.g., system of FIG. 1 with the circuitry of FIG. 4) configured to perform each of the processes.

The discussion and illustrations provided herein are presented in an exemplary format, wherein selected embodiments are described and illustrated to present the various aspects of the present invention. Systems, devices, or methods according to the present invention may include one or more of the features, structures, methods, or combinations thereof described herein. For example, a device or system may be implemented to include one or more of the advantageous features and/or processes described below. A device or system according to the present invention may be implemented to include multiple features and/or aspects illustrated and/or discussed in separate examples and/or illustrations. It is intended that such a device or system need not include all of the features described herein, but may be implemented to include selected features that provide for useful structures, systems, and/or functionality.

Although only examples of certain functions may be described as being performed by circuitry for the sake of brevity, any of the functions, methods, and techniques can be performed using circuitry and methods described herein, as would be understood by one of ordinary skill in the art.

We claim:

1. A method of switching horizontal directional drilling procedures during bore path turning, comprising:

identifying a hierarchal arrangement of a plurality of different boring procedures utilizing different boring techniques, the hierarchy arrangement representing boring procedures of increasing ability to bore through harder soil while changing a trajectory of a boring tool;

boring a first leg of a curved bore path using a boring tool connected to a drill rig by a drill string, the first leg being bored using a first boring procedure of the plurality of different boring procedures;

monitoring a plurality of boring parameters during boring of the first leg, the plurality of boring parameters comprising:

torsional pressure of the drill string;

rotational travel of the drill string;

hydraulic pressure; and axial displacement; and switching from boring the first leg of the curved bore path using the first boring procedure to boring a second leg using a second boring procedure of the plurality of boring procedures, the switch based on one or more of the boring parameters deviating past a threshold.

2. The method of claim 1, wherein the one or more of the plurality of parameters deviating past the parameter threshold indicates that the first boring procedure is suboptimal for boring soil of the second leg with respect to another boring procedure of the plurality of boring procedures.

3. The method of claim 1, wherein switching further comprises:

switching to using a higher boring procedure of the hierarchal arrangement when the one or more boring parameters exceeds a maximum threshold; and switching to using a lower boring procedure of the hierarchal arrangement when the one or more boring parameters falls below a minimum threshold.

4. The method of claim 3, wherein the maximum threshold and the minimum threshold are each predetermined for each boring procedure of the plurality of boring procedures of the hierarchal arrangement.

5. The method of claim 1, wherein the plurality of different boring procedures comprises a hierarchal arrangement of different boring procedures utilizing different boring techniques, each boring procedure of the plurality composed of a unique combination of boring actions.

6. The method of claim 1, wherein monitoring the plurality of boring parameters further comprises dividing one or both of the rotational travel and the axial displacement parameters by one or both of the torsional pressure and the hydraulic pressure parameters to calculate a comparison value indicating progress compared to machine stress, and wherein the switch between the first boring procedure and the second boring procedure is based on the comparison value deviating past the threshold.

7. A method of switching horizontal directional drilling procedures, comprising:

boring a curved bore path using a boring tool connected to a drill rig using a first boring procedure of a plurality of different boring procedures, the plurality of different boring procedures comprising a hierarchal arrangement of boring procedures representing boring procedures of increasing ability to bore through harder soil while changing the trajectory of the boring tool;

monitoring a plurality of boring parameters;

comparing at least one of the plurality of boring parameters to a parameter threshold; and switching from boring using the first boring procedure to boring using a second boring procedure of the plurality of boring procedures, the switch based on the parameter comparison.

8. The method of claim 7, wherein monitoring the plurality of boring parameters comprises monitoring at least one progress parameter indicative of boring progress and at least one operational parameter indicative of an operational state of a boring machine.

9. The method of claim 8, wherein comparing at least one of the plurality of boring parameters to the parameter threshold comprises comparing at least one of the progress parameters to at least one of the operational parameters to determine a parameter comparison value, wherein switching between using the first boring procedure to using the second boring procedure of the plurality of boring procedures is based on the parameter comparison value deviating past the parameter threshold.

10. The method of claim 9, wherein the parameter comparison value deviating past the parameter threshold indicates that the first boring procedure is suboptimal for efficiently boring soil of the second leg with respect to another boring procedure of the plurality of boring procedures.

11. The method of claim 7, wherein switching further comprises:

switching to using a higher boring procedure of the hierarchal arrangement when the parameter exceeds a maximum threshold; and switching to using a lower boring procedure of the hierarchal arrangement when the parameter falls below a minimum threshold.

12. The method of claim 11, wherein the maximum threshold and the minimum threshold are each predetermined for each boring procedure of the plurality of boring procedures.

13. A horizontal directional drilling machine, comprising:

a boring tool;

a drill string attached the to boring tool;

a boring rig coupled to the drill string, the boring rig having one or more motors configured to manipulate the drill string to bore a curved underground path;

one or more sensors configured to output one or more boring parameter signals containing boring parameter information;

memory; and a controller configured to execute program instructions stored in the memory to cause the horizontal directional drilling machine to switch from boring a curved path using a first boring procedure of a plurality of different boring procedures to a second boring procedure of the plurality of different boring procedures based on the boring parameter information deviating past a parameter threshold, wherein each boring procedure of the plurality of boring procedures comprises a unique combination of boring actions that the drill rig is configured to implement.

14. The horizontal directional drilling machine of claim 13, wherein the one or more sensors are configured to measure at least one progress parameter signal and output boring parameter information indicative of boring progress and at least one operational parameter signal and output parameter information indicative of machine stress of the horizontal directional drilling machine.

15. The horizontal directional drilling machine of claim 14, wherein the controller is configured to execute stored program instructions to compare parameter information of at least one of the progress parameter signals to parameter information of at least one of the operational parameter signals to determine a parameter comparison value, wherein the switch between using the first boring procedure to using the second boring procedure is based on the parameter comparison value deviating past the parameter threshold.

16. The horizontal directional drilling machine of claim 15, wherein the parameter comparison value deviating past the parameter threshold indicates that the first boring procedure is suboptimal for efficiently boring soil as measured by the one or more sensors with respect to another boring procedure of the plurality of boring procedures.

17. The horizontal directional drilling machine of claim 13, wherein the plurality of different boring procedures comprises a hierarchal arrangement of boring procedures stored in memory, the hierarchal arrangement representing boring procedures of increasing ability to bore through harder soil along the curved path that can be implemented by the controller and the boring rig.

18. The horizontal directional drilling machine of claim 17, wherein the controller is configured to execute stored program instructions to cause the horizontal directional drilling machine to:

switch to using a higher boring procedure of the hierarchal arrangement when the parameter information exceeds a maximum threshold; and switch to using a lower boring procedure of the hierarchal arrangement when the parameter information falls below a minimum threshold.

19. The horizontal directional drilling machine of claim 18, wherein the maximum threshold and the minimum threshold are each predetermined for each boring procedure of the plurality of boring procedures.

20. The horizontal directional drilling machine of claim 13, wherein the one or more sensors are configured to output parameter signals containing progress parameter information indicating boring progress along the curved path and operational information indicating stress on the horizontal directional drilling machine, and wherein the controller is configured to execute stored program instructions to calculate a comparison value indicating boring progress compared to machine stress by dividing the progress information by the operational information and switch from boring using the first boring procedure to the second boring procedure based on the comparison value deviating past the parameter threshold.

21. The horizontal directional drilling machine of claim 13, wherein the boring parameter information comprises a parameter indicating curvature of the drill string.

22. A system for boring, the system comprising:

means for mechanically boring a generally horizontal curved path through the ground using one of a plurality of boring procedures;

means for monitoring one or more parameters while boring; and means for switching using one of the plurality of boring procedures to using a different one of the boring procedures when one or more of the monitored parameters deviates from a preestablished range; wherein:

the plurality of boring procedures comprises a hierarchal arrangement of boring procedures, the hierarchy arrangement representing boring procedures of increasing ability to bore through harder soil while changing the trajectory of the boring tool, and the means for switching further comprises:

means for switching to using a higher boring procedure of the hierarchal arrangement when one or more of the monitored parameters exceeds a maximum threshold of the preestablished range; and means for switching to using a lower boring procedure of the hierarchal arrangement when one or more of the monitored parameters falls below a minimum threshold of the preestablished range.

* * * * *